US006315262B1

(12) United States Patent
Hur

(10) Patent No.: US 6,315,262 B1
(45) Date of Patent: Nov. 13, 2001

(54) AUTO-RETURNING HEIGHT-CONTROL ASSEMBLY FOR A CHAIR

(75) Inventor: Song Hur, Kyoungki-Do (KR)

(73) Assignee: Samhongsa Co., Ltd., Seoul (KR)

( * ) Notice: Subject to any disclaimer, the term of this patent is extended or adjusted under 35 U.S.C. 154(b) by 0 days.

(21) Appl. No.: 09/592,552

(22) Filed: Jun. 12, 2000

(30) Foreign Application Priority Data

Jun. 30, 1999 (KR) ..... 99-12434
Mar. 27, 2000 (KR) ..... 00-15559

(51) Int. Cl.[7] ..... F16M 13/00
(52) U.S. Cl. ..... 248/417; 248/162.1; 248/188.2
(58) Field of Search ..... 248/188.2, 188.3, 248/188.5, 188.8, 161, 162.1, 404, 415, 416, 417, 418, 406.2; 297/344.21

(56) References Cited

U.S. PATENT DOCUMENTS 1,895,226 * 1/1933 Kupski ..... 248/417
2,351,194 * 6/1944 Davies ..... 248/417
3,385,550 * 5/1968 Doerner ..... 248/417
3,837,611 * 9/1974 Rhoades ..... 248/417
5,269,398 * 12/1993 Wolf et al. ..... 188/300

FOREIGN PATENT DOCUMENTS

332426-B1 * 10/1958 (CH) ..... 248/417
134205-B1 * 6/1920 (GB) ..... 248/417

* cited by examiner

*Primary Examiner*—Ramon O. Ramirez
*Assistant Examiner*—Jon Szumny

(57) ABSTRACT

An auto-returning height control assembly comprising a spindle which is inserted in an outer cylinder and one end is fixed to an end of the outer cylinder, and a first and second cam member which are inserted between the outer cylinder and a sleeve member so that the spindle can rotates about its longitudinal axis and returns; its original place at the same time. At least one projection is formed on the sleeve member and the first cam member is fixed at the inside cylindrical surface of the outer cylinder. A projection is formed on the second cam member and the projection is inserted into the groove of a sleeve member and allows the up and down movement against the sleeve member. A spring is installed at the lower part of the second cam member to push the second cam member towards the first cam member.

16 Claims, 12 Drawing Sheets

AUTO-RETURNING HEIGHT-CONTROL ASSEMBLY FOR A CHAIR

BACKGROUND OF THE INVENTION

1. Field of the Invention

The present invention is related to an auto-returning height-control assembly for a chair wherein a chair returns to its original place automatically when a person stands up from a chair or sits down on a chair and turns the chair.

2. Description of the Background Invention

FIG. 1 is a vertical cross sectional view which shows a conventional height adjusting assembly for a chair. The conventional height adjusting assembly comprises a outer cylinder 600, a spindle guide 500 which is inserted and fixed inside the outer cylinder 600 and a spindle 150 which slides along the inside surface of the spindle guide 500.

The spindle 150 is connected with a piston rod 110 and extends outwards toward the outer cylinder. The height of the spindle is adjustable along the axis of the piston rod and a push button (133), which is put on and off to make the spindle move up and down along the axis of the piston rod, is installed at an outer end of the spindle. An end of the piston rod 110 is fixed to the outer cylinder 600 with a fixing clip 235. An elastic member 620 for absorbing the shock which is put on the outer cylinder 600 by the lower end of the spindle 150 when spindle 150 moves up and down along the axis of the piston rod is inserted at the lower end of the piston rod 110. A thrust bearing 142 is inserted at the lower end of the shock absorbing cushion member 620. A movement preventing projection 135 is formed a the lower end of the piston rod 110 in order to prevent the thrust bearing 142 from moving upwards. As the shock absorbing cushion member 620 and the thrust bearing 142 are inserted at the piston rod 110, the shock put on the spindle 160 is absorbed and the rotation static-electricity is reduced. A push button 133 is formed at an outer end of the spindle 150 and the spindle is allowed to rotate and move up and down along the inside of the spindle guide 500 according to the operation of the push button in the conventional auto-returning height control assembly. In the conventional art, the push button used in adjusting the height of a chair is formed at an end of the spindle 150 and an operation lever 188 located at the lower end of the chair is used to push the push button 133 as shown in FIG. 2.

As the conventional auto-returning height control assembly is structured to control the rotation of the spindle 150 inside the spindle guide 500, the seat 121 of a chair does not return to its original place after a person has used the chair and made it rotate in a certain degree. In order to make the seat of a chair return to its place, an artificial force has to be put on and rotate the seat. Therefore, there is inconvenience in arranging seats of chairs into their original places after using them, and especially, when there are larger number of chairs, it is time and manpower consuming to do all the chairs.

The present invention is to overcome the problems of the convention art by providing an auto-return height control assembly in which the seat of a chair returns to its place automatically after using the chair.

SUMMARY OF THE INVENTION

The present invention is conceived to solve the problem of the conventional height adjusting assembly and to provide a height adjusting assembly for chairs comprising a spindle which is projected outwards and is adjustable, a sleeve member which covers the outside of the spindle and in which more than one groove is formed along the direction of the axis at the outside of the spindle, a first cam member which allows the sleeve member to rotate about the longitudinal axis of the spindle, a second cam member which has projections inside and the projections are inserted into the groove of the sleeve member and moves up and down along the direction of the axis of the spindle against the sleeve member and rotates simultaneously along the rotation of the sleeve member, and an elastic member which pushes the second cam member to make the slope side of the second cam member to face the slope side of the first cam member.

The first cam member comprises a first cylindrical part and a second cylindrical part which has different diameter and is structures so that the second cam member can be inserted inside the second cylindrical part. One end of the elastic member is combined to the second cam member and the other end is limited in its movement along the length direction by the outer cylinder and if the rotation force of the sleeve member is eliminated, the elastic member returns to its place and pushes up the second cam member so that the slope side of the first and second cam member face each other and therefore, the sleeve member is rotated to its original place.

A projection is formed at a certain location of the outer cylinder and a washer is inserted between the projection and the elastic member in order to limit the moving direction of the elastic member. A ring in which more than one penetration hole is formed and a thrust bearing are installed between the elastic member and the second cam member and a spacer of a taper form which is fixed with the outer cylinder is installed at the lower part of the elastic member. The spacer, sleeve member, ring and the washer can be made of aluminum alloy, metal, metalloid and resin.

BRIEF DESCRIPTION OF ATTACHED DRAWINGS

DETAILED DESCRIPTION OF THE PRESENT INVENTION

The present invention will be described in detail hereinafter with reference to FIGS. 3 to FIGS. 14.

Preferred Embodiment 1

Figure 1:
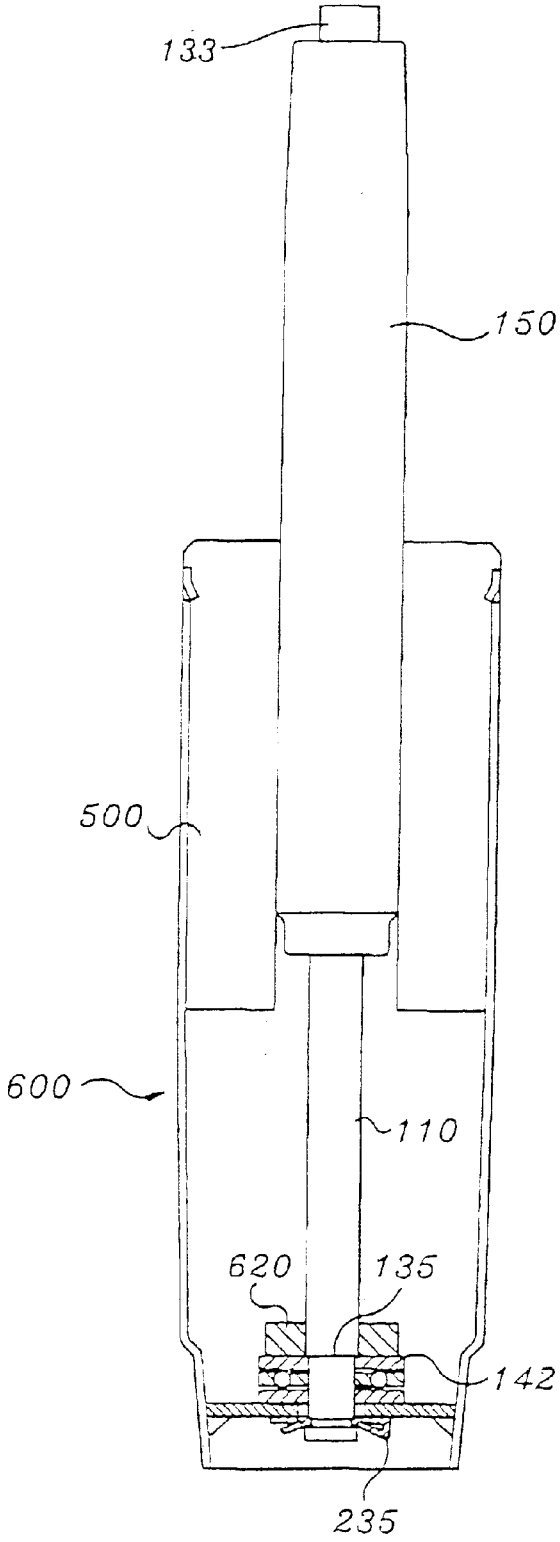
Fig. 1 Prior Art
FIG. 1 is a vertical cross sectional view which shows the conventional height adjusting assembly for chairs.
Figure 2:
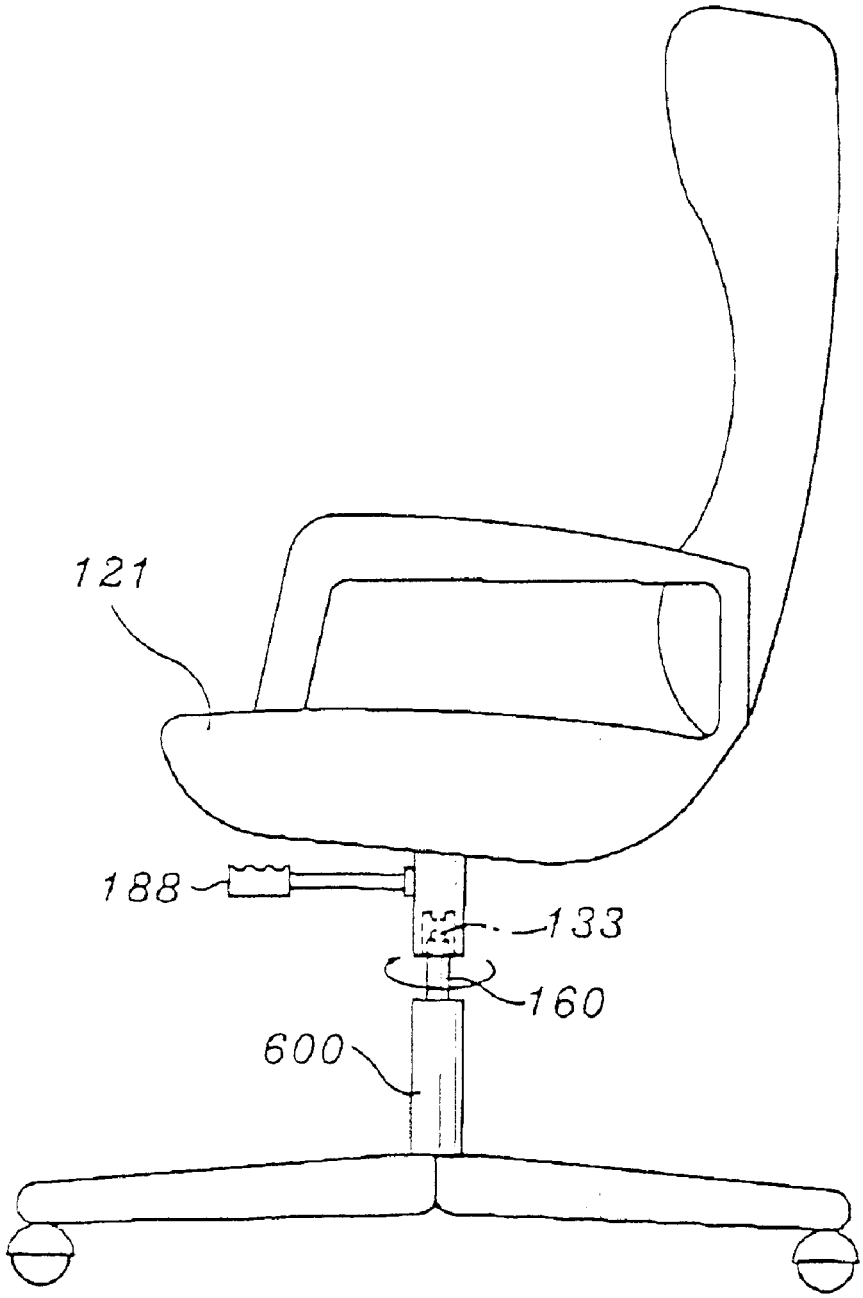
Fig. 2 Prior Art
FIG. 2 is an aspect of a conventional chair.
Figure 3:
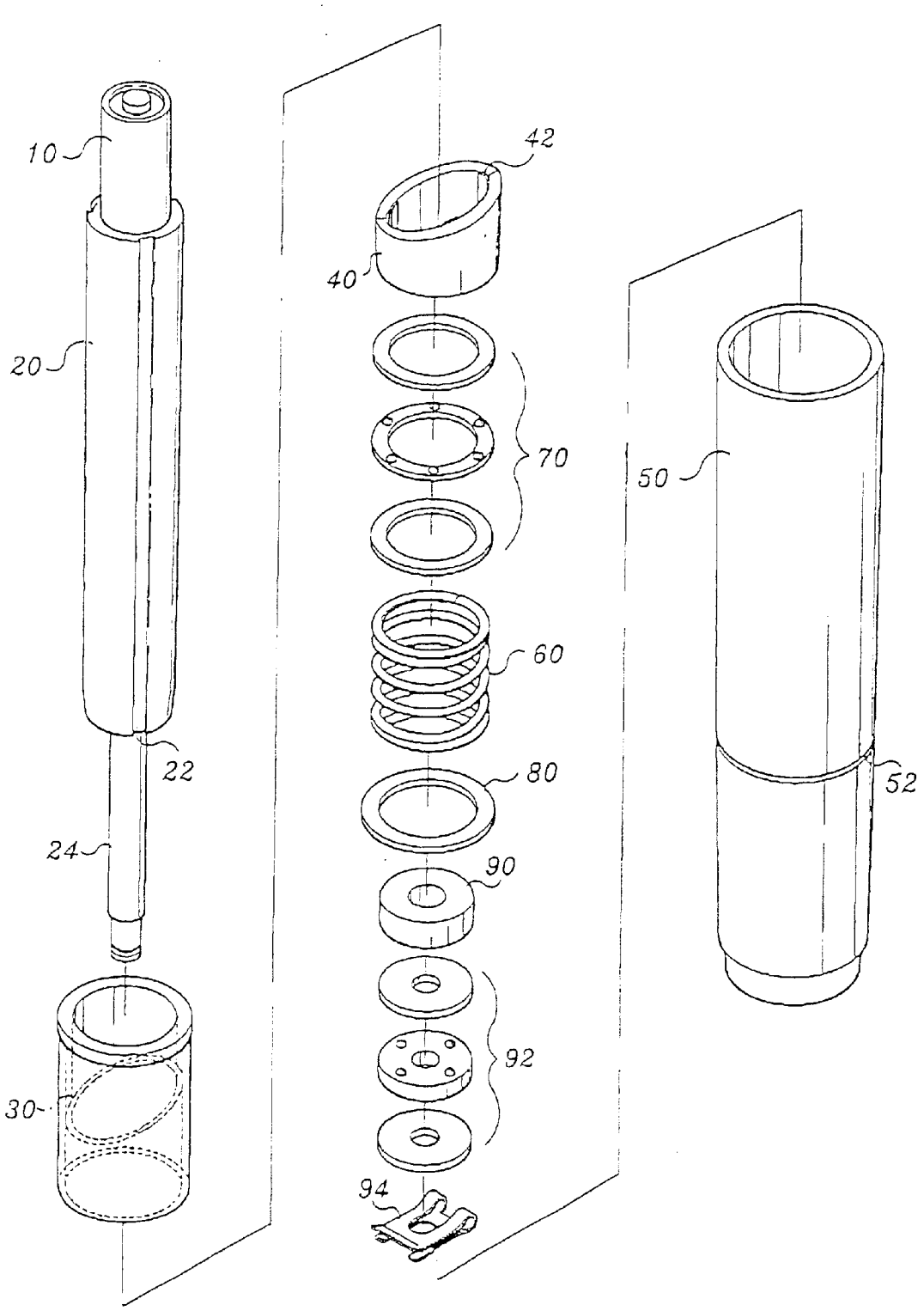
FIG. 3 is a exploded drawing of the auto-returning height adjusting control assembly for chairs according to the first preferred embodiment of the present invention.
Figure 4:
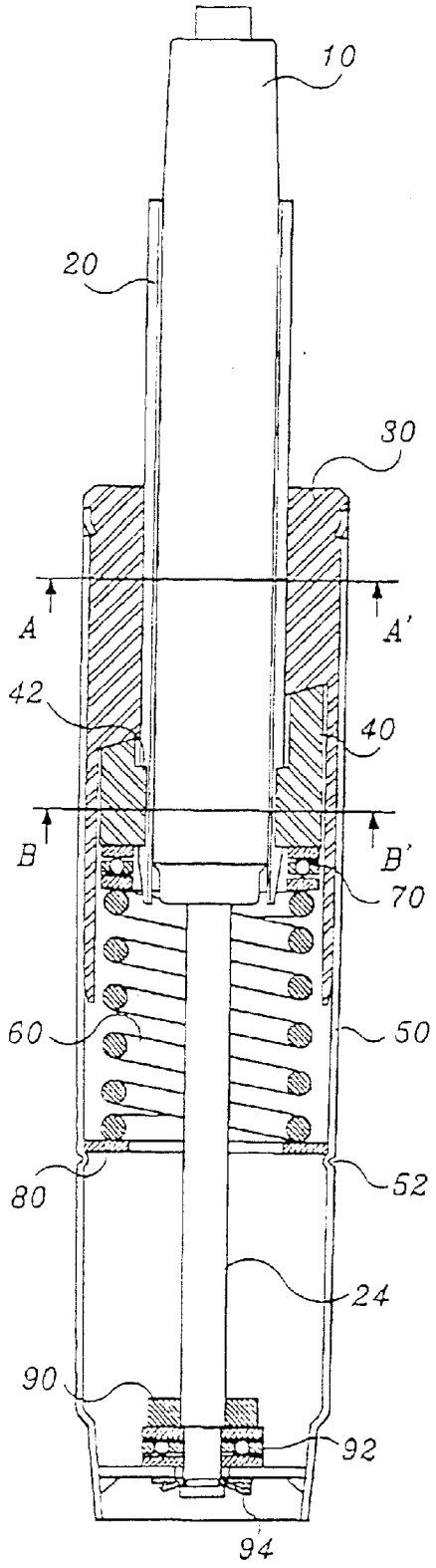
FIG. 4 is a vertical cross sectional view showing the spindle of FIG. 3 which has not rotated.
Figure 5:
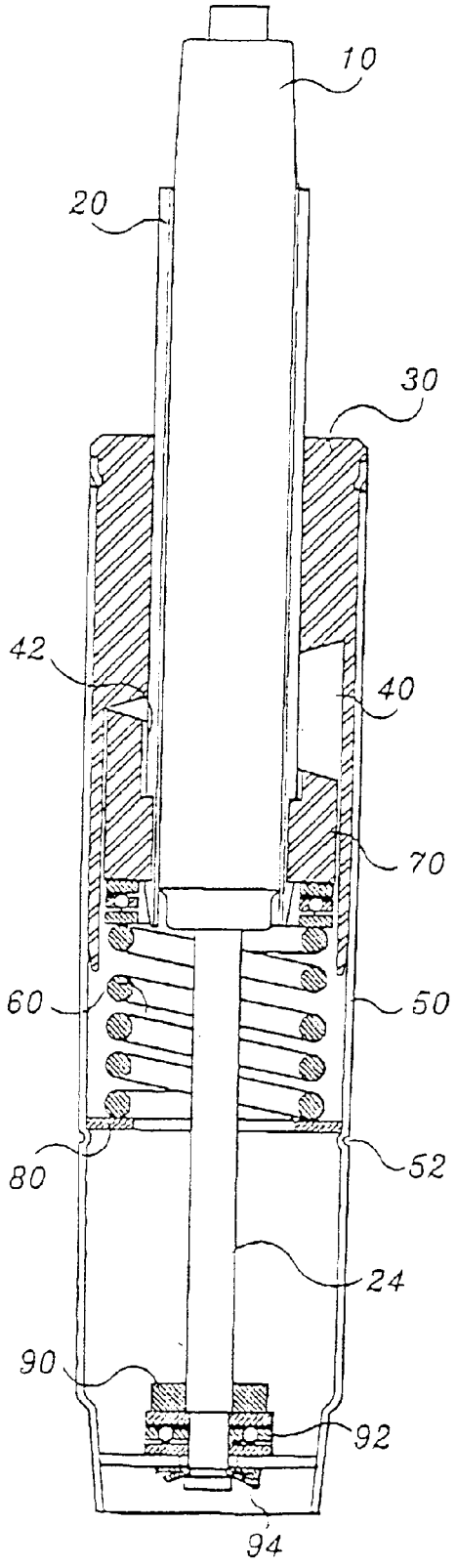
FIG. 5 is a vertical cross sectional view showing the spindle of FIG. 3 which has rotated.
Figure 6:
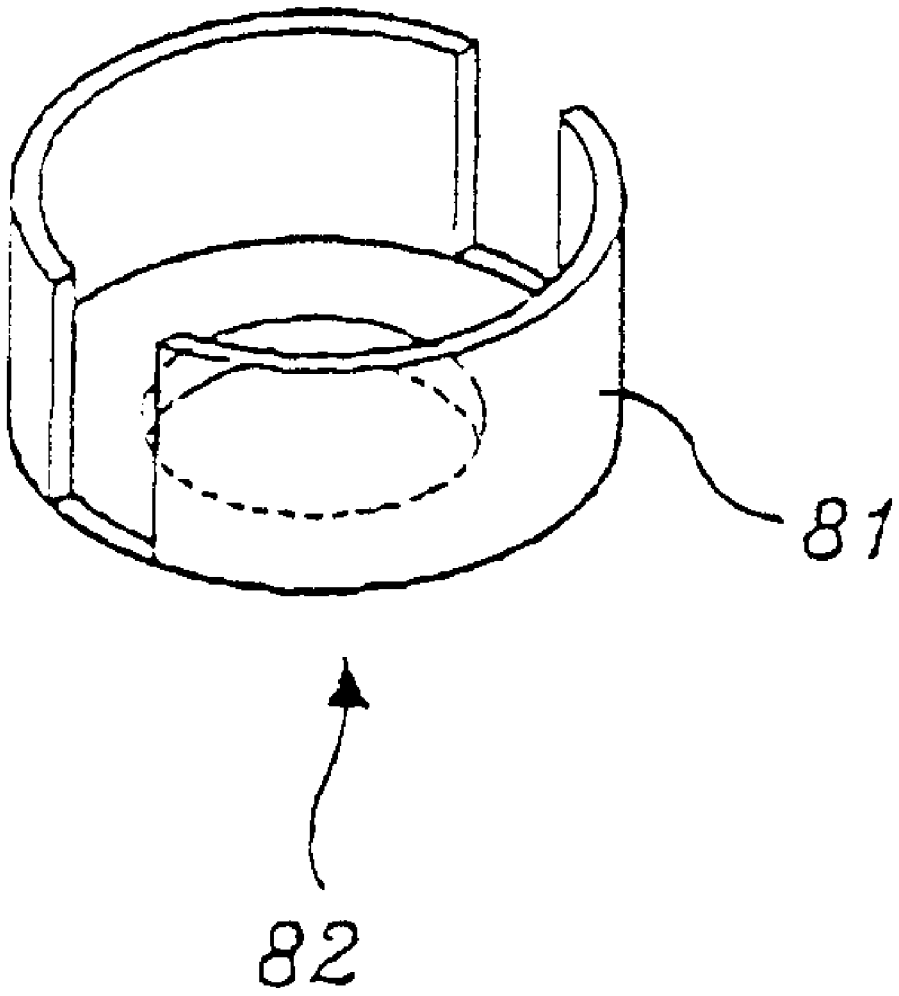
FIG. 6 is a cross sectional view showing the structure of the spring guide part.
Figure 7:
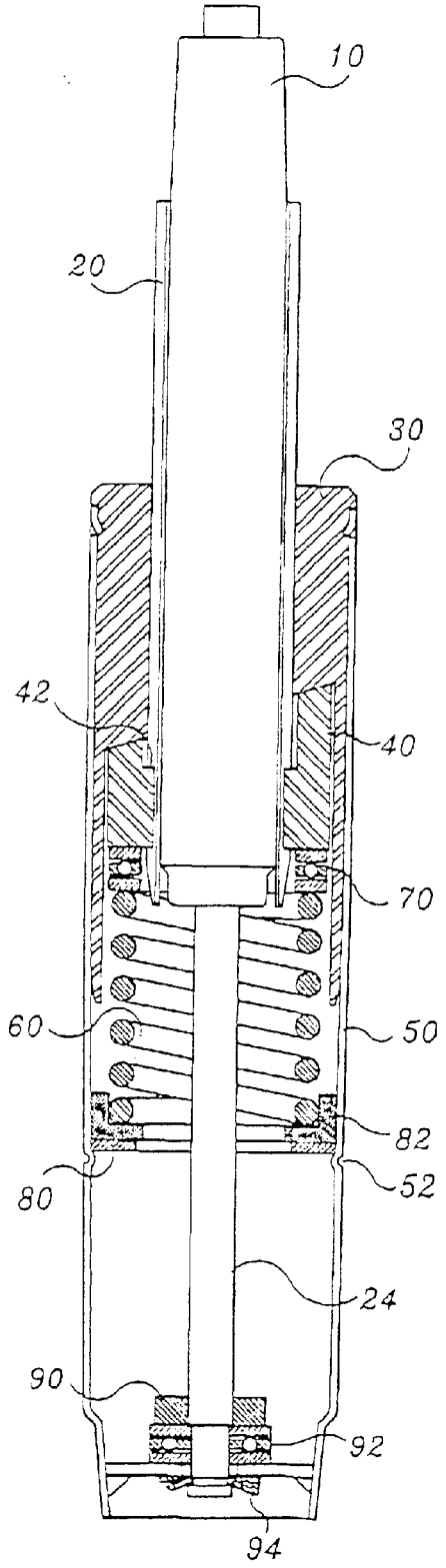
FIG. 7 is a cross sectional view showing the application of the spring guide part of FIG. 6.
Figure 8:
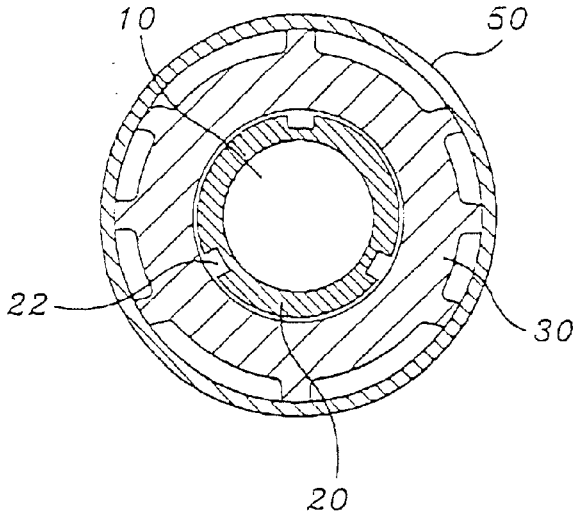
FIG. 8 is a cross sectional view cut along the line A–A' of FIG. 4.
Figure 9:
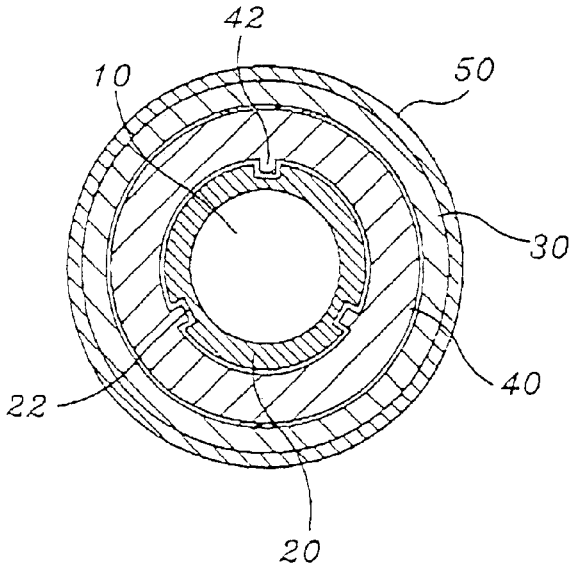
FIG. 9 is a cross sectional view cut along the line B–B'.
Figure 10:
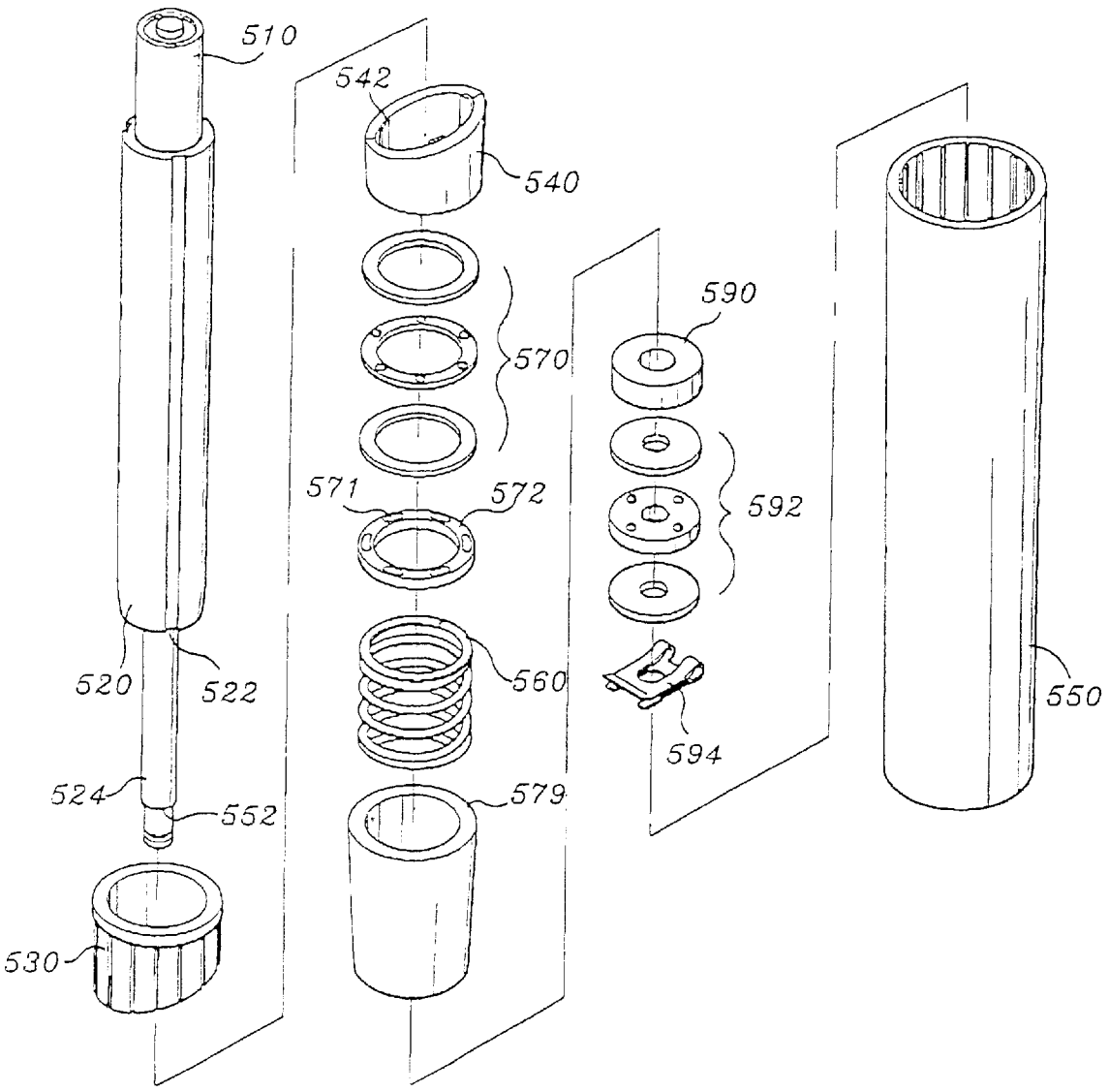
FIG. 10 is a exploded drawing of the auto-returning height adjusting control assembly for chairs according to the second preferred embodiment of the present invention.

The auto-returning height adjusting control assembly according to the present invention comprises a spindle 10, a sleeve member 20 which covers the body part of the spindle, an upper cam 30 (a first cam member) in which a slope side of cam form is formed at the lower part in which the sleeve member 20 is inserted, a lower cam 40 (a second cam member) which has slope side of cam form corresponding to the slope side of the upper cam 30 at the upper part and which is combined with the sleeve member 20, an outer cylinder 50 in which one end is fixed with the upper cam, and a spring 60 as shown in FIGS. 3 to 9. In particular, the upper cam 30 comprises a first and second cylindrical part which have different diameters as shown in FIGS. 4, 8, and 9. The lower cam 40 is located inside the second cylindrical part of the upper cam.

The groove 22 is formed along the length direction at the outer cylindrical surface of the sleeve member 20 which is combined with the spindle 10. The sleeve member 20 is inserted at the upper cam 30, and the lower cam 40, in which projections are formed inside, is formed at the lower part of the upper cam 30. The sleeve member 20 is made of aluminum, aluminum alloy, metal, metalloid or resin.

The upper part of the upper cam is formed with a certain thickness and the lower part is formed thinly. The upper part and the lower part are in one body. The upper cam 30 guides the lower cam 40, thrust bearing 70 and the spring 60. The projections 42 corresponding to the groove 22 of the sleeve 20 are formed inside the cylindrical surface of the lower cam 40 along the length direction and combines to the groove 22 of the sleeve member 20. One end of the spring 60 is combined to the lower cam 40 and the other end is limited in its movement along the length direction by the outer cylinder 50. The thrust bearing 70 is inserted between the lower cam 40 and the spring 60. The thrust bearing 70 is made of metal or resin.

A projection 52 is formed on a certain location of the outer cylinder 50 and a washer 80 is inserted between the projection 52 and the spring 60 and the movement in length direction of the spring is limited. An extra spring guide part 82 including a supporting guide part 81 is formed on the washer 80 as shown in FIGS. 6 and 7 to guide the spring 60. One end of the piston rod 24 is fixed to the outer cylinder 50 with a fixing clip 94. A shock absorbing cushion member 90 is inserted at the lower part of the piston rod 24 in order to absorb the shock put on the outer cylinder 50 by the lower part of the spindle when the spindle moves up and down. A thrust bearing 92 is inserted at the lower part of the shock absorbing cushion member 90 in order to reduce the rotation static electricity. The sleeve member 20 rotates when a rotation force is put on the spindle 10 and the lower cam 40 rotates inside the second cylindrical part of the upper cam 30 by the projection 42 of the lower cam 40 which is combined to the groove 22 of the sleeve member 20. The lower cam 40 moves down by the slope side of the upper cam and the spring is pressed by this movement.

The pressed spring returns to its original place when the rotation force put on the spring is eliminated and pushes the lower cam 40 up so that the upper cam 40 and the slope side of the lower cam contact one another. The lower cam 40 rotates the sleeve member 20 and the spindle 10 which are combined by the projection to its original place.

Preferred Embodiment 2

The auto-returning height control assembly of this preferred embodiment comprises a spindle 510, a sleeve member 520 which covers the spindle 510 and which is fixed, an upper cam 530 (a first cam member) in which the sleeve member 520 is inserted and in which a slope side of a cam form is formed, a lower cam 540 (a second cam member) which is combined with the sleeve member and in which a slope side of a cam form corresponding to the cam form of the upper cam is formed at the upper part, an outer cylinder 550 in which on end is fixed with the upper cam and a spring 560.

The upper cam 530 and the lower cam 540 contact the outer cylinder 550 separately. The upper cam 530 is fixed to the upper part of the outer cylinder 550 and lower cam 540 is structured to move in the direction of the longitudinal axis of the spindle along the inside cylindrical surface of the outer cylinder 550. A groove 522 is formed at the outer cylindrical surface of the sleeve member 520 which is combined with the spindle 510 along the length direction. The sleeve member 520 is inserted at the upper cam 530, and the lower cam 540, in which a projection 542 is formed at the inside cylindrical surface, is formed at the lower part of the upper cam 530. The sleeve member 520 is made of aluminum, aluminum alloy, metal, metalloid or resin. The sleeve member 520, in which the groove is formed, is rotatable about the longitudinal axis thereof 550.

Figure 11:
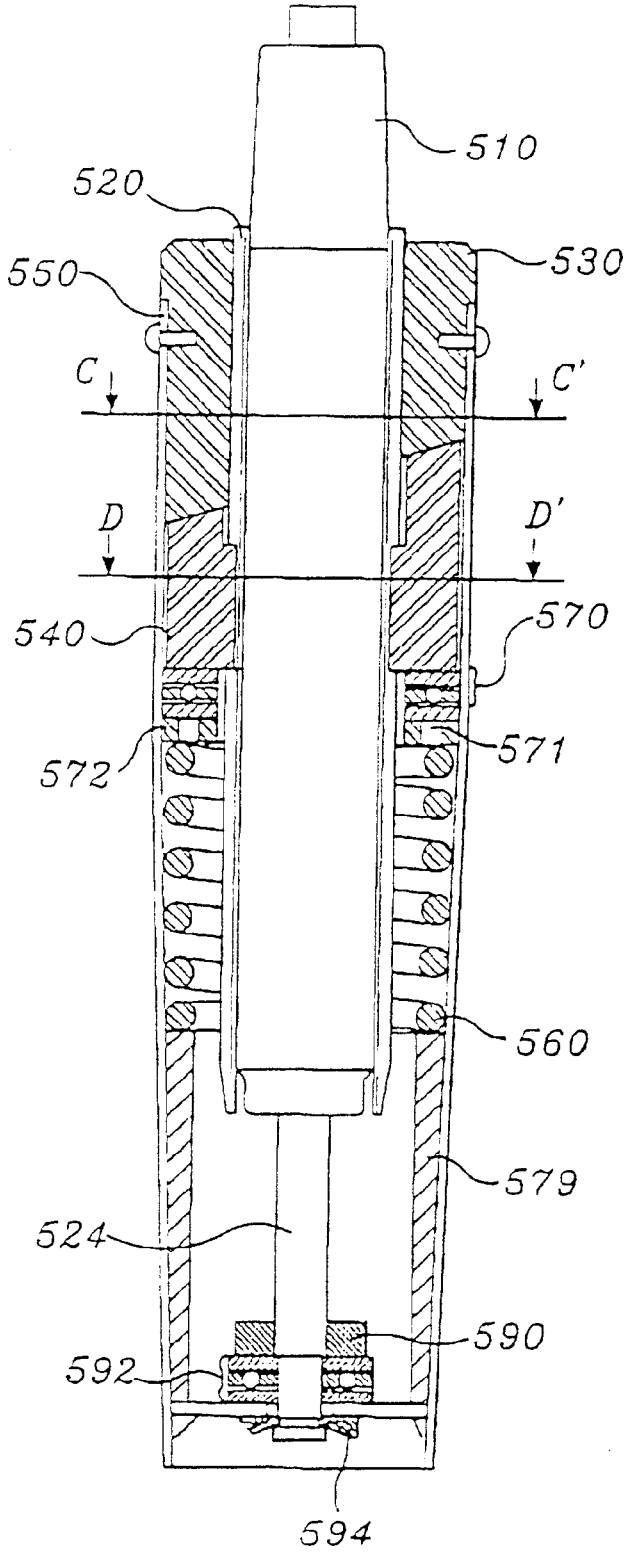
FIG. 11 is a vertical cross sectional view showing the spindle of FIG. 10 which has not rotated.
Figure 12:
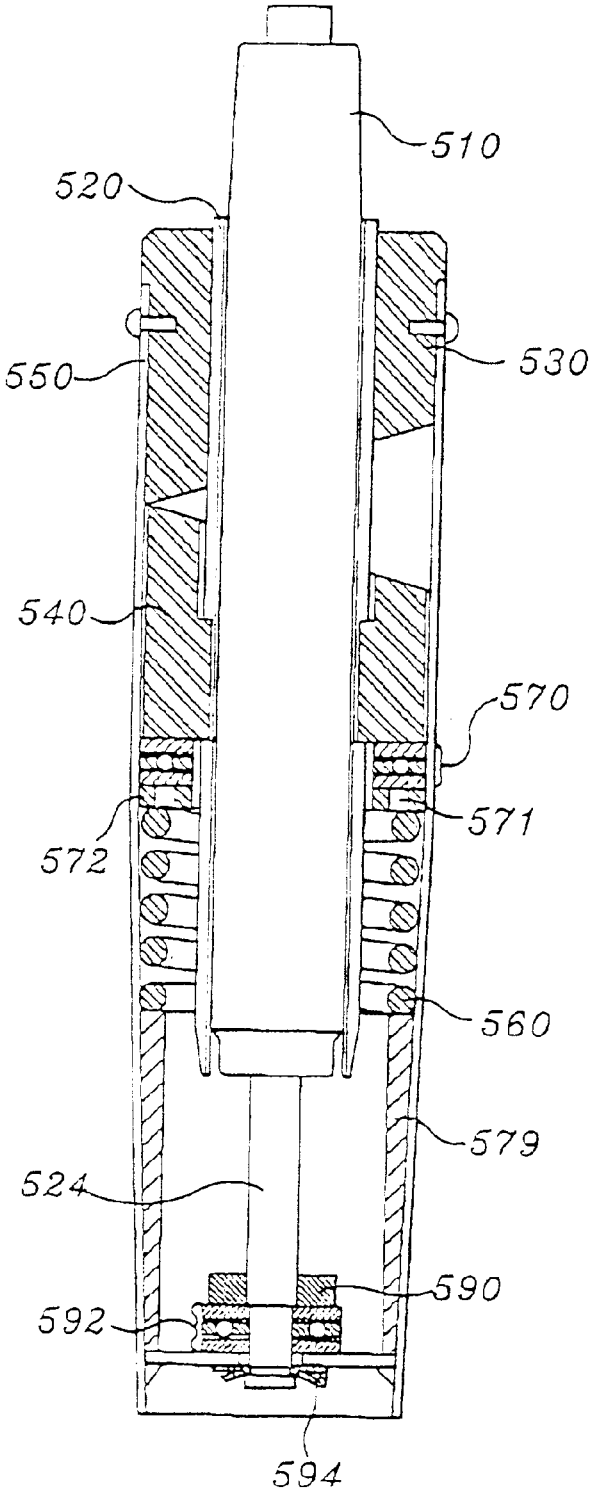
FIG. 12 is a vertical cross sectional view showing the spindle of FIG. 10 which has not rotated.
Figure 13:
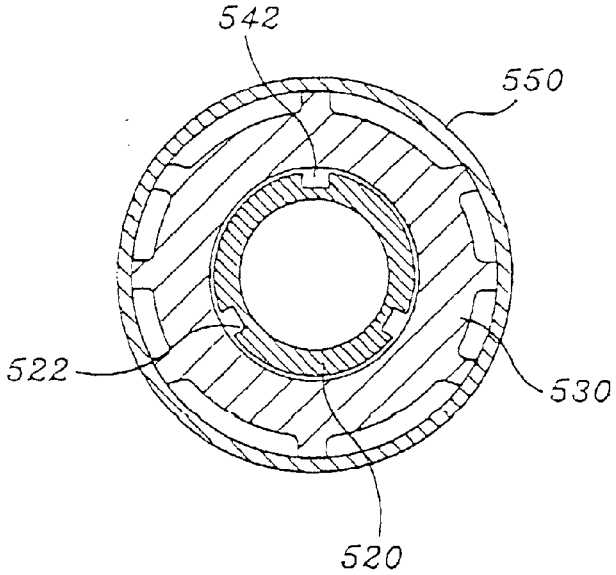
FIG. 13 is a cross sectional view cut along the line C–C' of FIG. 11.

The structure in which the upper cam 530, the sleeve member 520 and the spindle 510 are combined is shown in FIG. 13 which is a view cut along C–C' of FIG. 11. The outer cylindrical surface of the upper cam 530 is inserted in the outer cylinder 550 and is fixed not to move and the sleeve member 520, in which the groove 522 is formed and which covers the spindle 510, is inserted inside the cylindrical surface of the upper cam 530 to rotate. A projection 542 which faces the groove 522 of the sleeve member 520 is formed along the direction of length inside cylindrical surface of the lower cam 540 and combines with the groove 522 of the sleeve member 520.

Figure 14:
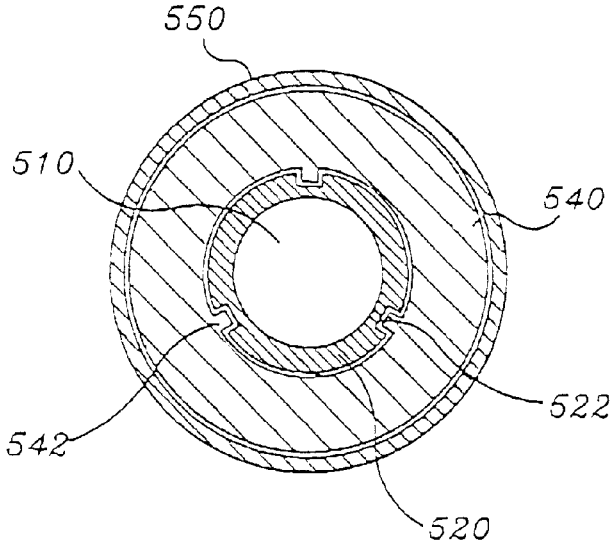
FIG. 14 is a cross sectional view cut along the line D–D' of FIG. 11.

The structure in which the lower cam 540, the sleeve member 520 and the spindle 510 are combined is shown in FIG. 14 which is a view cut along D–D' of FIG. 11. An outer cylindrical surface of the lower cam 540 is inserted along the inside cylindrical surface of the outer cylinder 550 to engage in sliding movement. The projection 542 formed at the inside cylindrical surface of the lower cam 540 is inserted at the groove 522 of the sleeve member 520 to rotate in the same direction of the sleeve member 520. The sleeve member 520 can move up and down against the lower cam 540. In other words, the lower cam 540 moves up and down along the longitudinal axis of the spindle against the sleeve member 520 by the projection 542 of the lower cam 540, and the lower cam 540 is installed inside the outer cylinder 550 to rotate in the same direction as the sleeve member 520.

One end of the spring 560 contacts the lower cam 540 and the other end is fixed to the inside cylindrical surface of the outer cylinder 550 and contacts a spacer 579. The spacer 579 is made of aluminum, aluminum alloy or resin material of metalloid. A thrust bearing 570 and a ring 572 in which a plurality of penetration holes 571 are formed are inserted between the lower cam 540 and the spring 560. The thrust bearing 570 and the ring 572 are made of metal or resin. The thrust bearing and the ring reduce the friction force between the lower cam 540 and the spring 560 when rotating with the sleeve member 520, and the ring makes the thrust bearing and the spring contact each other closely and guides the spindle when it slides up and down.

The outer cylinder 550 is fixed with the fixing clip 594 at the end of the piston rod 524. A shock absorbing cushion member 590 is inserted at the lower part of the piston rod 524 in order to absorb the shock put on the outer cylinder 550 by the lower part of the spindle 510 when the spindle engages in up and down movement. A thrust bearing 592 is inserted at the power part of the shock absorbing cushion member 590 in order to reduce the rotation frictional force of the spindle 510.

The sleeve member 520 rotates when the rotation force is put on the spindle 510 and the lower cam 540 rotates by the projection 542 of the lower cam 540 which is combined to the groove 522 of the sleeve member 520. The slope side of the upper cam and the lower cam is in symmetrical position with one another and the lower cam 540 moves down and presses the spring 560. The spring returns to its original place when the rotation force put on the sleeve member 520 is eliminated and presses the lower cam so that the slope side of the lower cam and the upper cam contacts one another. As a result, the sleeve member 520 and the spindle 510 returns to its place automatically. According to the invention the seat of a chair returns to its place without applying artificial force to the seat.

The effect of the invention is to provide a chair in which the seat is returned to its original place by eliminating the rotation force put on the spindle of the auto-returning height control assembly and using the elasticity of the spring and the operation of the upper and lower cam.

What is claimed is:

1. An auto-returning height control assembly in which an outer cylinder and a spindle are included and the spindle is projected outwards inside the outer cylinder comprises;

a sleeve member which covers and fixes an outer cylindrical surface of the spindle and in which more than one projection is formed along the direction of its axis;

a first cam member which allows the sleeve member in which the grooves are formed to rotate about its logitudinal axis and in which an side is in slope and combined to an inside cylindrical surface of an outer cylinder;

a second cam member in which a projection is formed inside the inner cylindrical surface and the projection is inserted into the groove of the sleeve member so that up and down movement against the sleeve member is done and rotates simultaneously with the sleeve member along the rotation direction of the sleeve member and in which a slope side corresponding to the slope side of the first cam member is formed; and an elastic member which pushes the second cam member inside the outer cylinder and makes the slope side of the first cam member and the second cam member contact one another.

2. The auto-returning height control assembly according to claim 1 wherein the first cam member comprises a first cylindrical part and a second cylindrical part which have different diameters and the second cam member is structured to be inserted inside the second cylindrical part.

3. The auto-returning height control assembly according to claim 2 wherein one end of the elastic member contacts the second cam member and the other end is limited in its movement in its longitudinal direction by the outer cylinder and makes the slope side of the second cam member and the first cam member to contact each other to return the sleeve member to its original place by pushing the second cam member as rotation force of the sleeve member is eliminated.

4. The auto-returning height control assembly according to claim 2 wherein a projection is formed on a certain location of the outer cylinder and a washer is inserted between the projection and the elastic member to limit the movement of the elastic member.

5. The auto-returning height control assembly according to claim 4 wherein a guide part of the elastic member is formed along the vertical direction of the outer cylindrical surface at the washer.

6. The auto-returning height control assembly according to claim 2 wherein the sleeve member is made of at least one material among aluminum alloy, metal, metalloid and resin.

7. The auto-returning height control assembly according to claim 2 wherein a thrust bearing is inserted between the elastic member and the second cam member.

8. The auto-returning height control assembly according to claim 2 wherein the elastic member is spring.

9. The auto-returning height control assembly according to claim 1 wherein the first cam member and the second cam member are separated up and down by the boundary of the corresponding slope sides and the second cam member can move in the direction of rotation and axis as the outer cylindrical surface contacts the outer cylinder.

10. The auto-returning height control assembly according to claim 9 wherein a lower part of the elastic member is supported by a spacer which is fixed with the outer cylinder.

11. The auto-returning height control assembly according to claim 10 wherein the spacer is formed in a cylindrical taper form.

12. The auto-returning height control assembly according to claim 11 wherein the spacer is made of at least one material among aluminum alloy, metal, metalloid and resin.

13. The auto-returning height control assembly according to claim 9 wherein the elastic member is spring.

14. The auto-returning height control assembly according to claim 9 wherein a ring is inserted between the elastic member and the second cam member.

15. The auto-returning height control assembly according to claim 14 wherein at least more than one penetration hole is formed at the outer area of the ring along the axis direction of the spindle.

16. The auto-returning height control assembly according to claim 14 wherein a thrust bearing is inserted between the ring and the second cam member in order to prevent the elastic member from rotating simultaneously with the second cam member.

* * * * *